US008720765B2

(12) United States Patent
Tanimoto et al.

(10) Patent No.: US 8,720,765 B2
(45) Date of Patent: May 13, 2014

(54) NAILING MACHINE

(75) Inventors: Hideyuki Tanimoto, Ibaraki (JP); Hiroyuki Oda, Ibaraki (JP); Yoshihiro Nakano, Ibaraki (JP); Takashi Ueda, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 1082 days.

(21) Appl. No.: 12/105,088

(22) Filed: Apr. 17, 2008

(65) Prior Publication Data

US 2008/0257934 A1 Oct. 23, 2008

(30) Foreign Application Priority Data

Apr. 18, 2007 (JP) ..... P2007-109066

(51) Int. Cl.
*B25C 1/00* (2006.01)

(52) U.S. Cl.
USPC ..... 227/134; 227/10; 227/107

(58) Field of Classification Search
USPC ..... 227/10, 134, 107
See application file for complete search history.

(56) References Cited

U.S. PATENT DOCUMENTS 3,275,209 A * 9/1966 Hansen ..... 227/10
3,589,587 A * 6/1971 Manganaro ..... 227/131
3,682,254 A * 8/1972 Hoeffleur ..... 173/49
4,161,272 A * 7/1979 Brockl ..... 227/131
4,200,213 A * 4/1980 Liesse ..... 227/10
6,032,847 A * 3/2000 Ehmig et al. ..... 227/10
7,798,383 B2 * 9/2010 Liesse ..... 227/9
8,534,527 B2 * 9/2013 Brendel et al. ..... 227/132

FOREIGN PATENT DOCUMENTS

JP 62-155342 A 7/1987
JP 2-47448 U 3/1990
JP 09295283 11/1997
JP 2000-337415 A 12/2000

OTHER PUBLICATIONS http://www.acewirespring.com/conical-compression-springs.html.*
Japanese Office Action, and English translation thereof, issued in Japanese Patent Application No. JP 2007-109066 dated May 7, 2012.

* cited by examiner

*Primary Examiner* — Hemant M Desai
*Assistant Examiner* — Gloria R Weeks
(74) *Attorney, Agent, or Firm* — McDermott Will & Emery LLP

(57) ABSTRACT

According to an aspect of the present invention, there is provided a nailing machine including: a housing; a motor that is accommodated in the housing; a plunger that plunges a nailing member; and a spring that is expanded or compressed by the motor to store an elastic energy therein and that accelerates the plunger by releasing the elastic energy, wherein a spring constant of the spring at one end of the spring in an expanding/compressing direction is set smaller than that of the spring at a center in the expanding/compressing direction.

11 Claims, 3 Drawing Sheets

NAILING MACHINE

CROSS-REFERENCE TO RELATED APPLICATIONS

This application is based upon and claims a priority from prior Japanese Patent Application No. 2007-109066 filed on Apr. 18, 2007, the entire contents of which are incorporated herein by reference.

BACKGROUND OF THE INVENTION

1. Field of the Invention

An aspect of the present invention relates to a nailing machine.

2. Description of the Related Art

Spring-driven nailing machines pushing up a plunger, which is urged by a nailing spring, against the urging force of the nailing spring to a top dead center, accelerating the plunger by opening the nailing spring, and driving a nail into a target member with the plunger have already been produced. In the nailing machines, the labor for pushing up the plunger is reduced by pushing the plunger by the use of the motor built in the housing. Specifically, as described in JP-9-295283-A, plural rotating gears coupled to the motor with a reduction gear therebetween are disposed opposite each other and a driving pin fixed to a position departing from the rotation centers of the rotating gears is made to engage with an engaging protrusion formed in the plunger. The plunger is pushed up by a predetermined stroke by the use of the driving pin.

A nailing spring used in the conventional nailing machines is urged at the position of a top dead center by a motor, etc. to accumulate elastic energy and is opened at the time of hitting to move toward a bottom dead center. When an end of the nailing spring reaches the position of the bottom dead center, the end of the nailing spring starts being compressed, and the other end of the nailing spring moves to the bottom dead center, whereby the elastic energy is accumulated in the nailing spring at the position of the bottom dead center again. When the nailing spring is compressed to some extent, the nailing spring moves toward the top dead center with the accumulated elastic energy and the other end of the nailing spring reaches the position of the top dead center, whereby the elastic energy is accumulated in the nailing spring again.

By repeating this operation at the positions of the top dead center and the bottom dead center, the nailing spring is attenuated to return to the before-nailing state. Accordingly, the ends of the nailing spring always reach the position of the top dead center and the position of the bottom dead center and thus both ends of the nailing spring essentially suffer from the greatest impact and thus are expanded and compressed. Therefore, the nailing spring might be deteriorated from the ends. As a countermeasure, it can be considered that the strength of the nailing spring is enhanced by enlarging the nailing spring. However, in this case, the nailing machine increases in size, the spring constant is enhanced, and the hitting power becomes too strong, thereby damaging the workability. An object of the invention is to provide a nailing machine having a small size and a long lifetime.

SUMMARY OF THE INVENTION

In order to accomplish the above-mentioned object, the invention provides a nailing machine including: a housing; a motor disposed in the housing; a plunger hitting a nailing member; and a spring that is expanded or compressed by the motor to accumulate elastic energy and that accelerates the plunger by opening the elastic energy, wherein a spring constant of the spring is smaller at ends in the expanding and compressing direction than at the center in the expanding and compressing direction.

It is preferable that at least one end of the ends of the spring has a spring constant smaller than that of the center thereof.

According to the above-mentioned configuration, since the spring constant of the ends of the spring is small, the ends of the spring can be easily expanded and compressed. Accordingly, even when an impact is applied to the ends of the spring, it is possible to easily absorb the impact. As a result, it is possible to improve the durability of the ends of the spring against the expansion and compression. Since the center portion of the spring has a great spring constant, it is possible to accumulate the elastic energy required for the hitting of the plunger. Accordingly, the hitting can be suitably performed without using a large spring, thereby accomplish a decrease in size of the nailing machine.

It is preferable that the spring is an unequal-pitch coil spring.

It is preferable that the unequal-pitch coil spring is formed of a winding wire and the radial length in the section of the winding wire in the radial direction of the unequal-pitch coil spring is greater than the axial length of the unequal-pitch coil spring in the section. It is also preferable that the spring includes end turn regions and an effective turn region and the effective turn region has an unequal pitch.

According to the above-mentioned configuration, in the spring accumulating constant elastic energy, it is possible to reduce the length of the most compressed spring. Accordingly, since it is possible to reduce the length of the spring, it is possible to reduce the size of the nailing machine.

BRIEF DESCRIPTION OF THE DRAWINGS

Embodiments of the present invention will be described in detail based on the following figures, wherein.

DETAILED DESCRIPTION OF THE INVENTION

Figure 1:
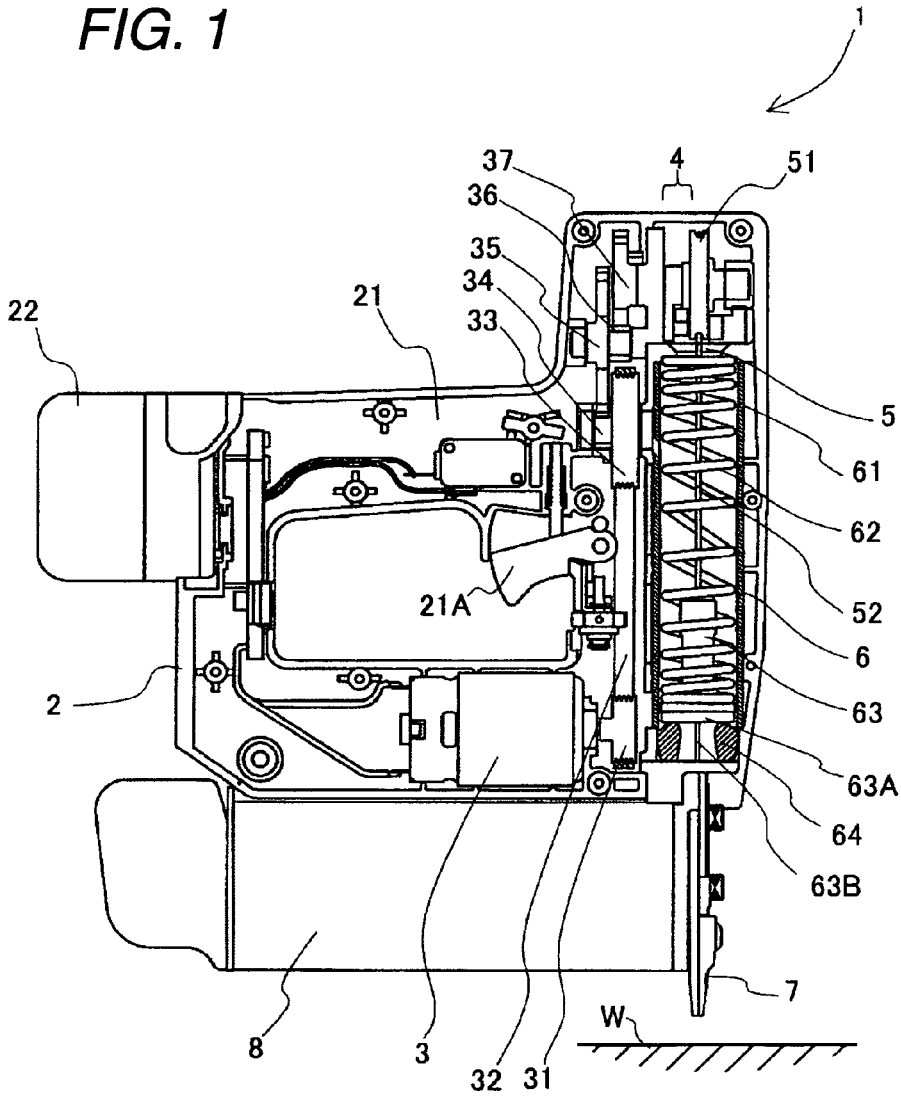
FIG. 1 is a cross-sectional view illustrating a nailer according to an embodiment.

Hereinafter, a nailing machine according to an embodiment of the invention will be described with reference to FIGS. 1 to 4. A nailer 1 which is a nailing machine shown in FIG. 1 is of an electromotive type and is used to insert a nail, which is a fixing member not shown, into a target member W such as timber and plaster. The nailer 1 roughly includes a housing 2, a motor 3, a clutch mechanism 4, a transmission portion 5, a coil spring portion 6, a nose portion 7, and a magazine 8. In the following description, a direction in which a plunger 63 described later moves is defined as a vertical direction and a direction in which the plunger 63 is urged by a coil spring 62 of the coil spring portion 6 described later to hit a nail not shown is defined as a downward direction.

The housing 2 is made of resin such as nylon and polycarbonate and has the motor 3 built therein. A handle 21 is disposed in an upper portion of the housing 2 and a trigger 21A controlling the motor 3 is disposed in the handle 21. A detachable battery 22 supplying power to the motor 3 is disposed at an end of the handle 21.

The motor 3 is disposed below the handle 21 in the housing 2 and a rotation shaft thereof is perpendicular to the vertical direction. The rotation shaft of the motor 3 is provided with a first pulley 31 and a belt 32 is suspended on the first pulley 31. The belt 32 extends upward from the first pulley 31 and is suspended on a second pulley 33 at the top end of the belt 32. The second pulley 33 is rotatably supported by the housing 2 and a first gear 34 coaxially rotating is disposed in parallel thereto. A second gear 35 engaging with the first gear 34 is disposed above the first gear 34. The second gear 35 is rotatably supported by the housing 2 and a third gear 36 coaxially rotating is disposed in parallel thereto. A fourth gear 37 engaging with the third gear 36 is disposed above the third gear 36. The number of rotations of the motor 3 is reduced by the first gear 31 to the fourth gear 37 and the rotary power is transmitted to the clutch mechanism 4.

One end of the clutch mechanism 4 is connected to the fourth gear 37 so as to be coaxially rotatable and the other end is connected to a drum 51 described later so as to be coaxially rotatable. One end and the other end of the clutch mechanism 4 are connected to each other to coaxially rotate in a bundle, until one end thereof is made to rotate by a predetermined angle (an angle required for the plunger 63 to reach the top dead center, about 270°) by the fourth gear 37. In a state where one end rotates by the predetermined angle, the clutch mechanism 4 intercepts the connection between one end and the other end thereof, whereby the other end (the drum 51 side) can freely coaxially rotate relative to one end (the fourth gear 37 side).

The transmission portion 5 roughly includes a drum 51 and the wire 52. The drum 51 has substantially a disk shape and is disposed in the axis of a blade 63B described later. One end of the wire 52 is fixed into a groove formed in the outer periphery of the drum 51 and the other end is connected to an urging portion 63A described later. The wire is formed by bundling fiber-like steel wires and the surface thereof is coated with resin.

The coil spring portion 6 roughly includes a spring guide 61, a coil spring 62, and a plunger 63. The spring guide 61 is separated from the housing 2, is made of aluminum or resin such as nylon and polycarbonate, and has a cylinder shape. The spring guide is disposed in the housing 2 so that the axial direction thereof is parallel to the vertical direction.

Figure 2:
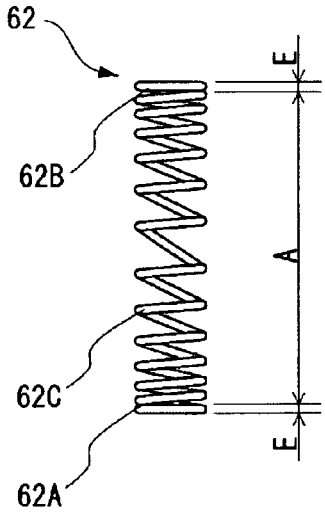
FIG. 2 is a side view illustrating a coil spring of the nailer according to the embodiment.

The coil spring 62 has a configuration in which a steel wire is wound and the outer diameter thereof is slightly smaller than the inner diameter of the spring guide 61, whereby the coil spring is inserted into the spring guide 61. As shown in FIG. 2, end turn regions E are defined in both ends of the coil spring 62 and an effective turn region A is defined between one end turn region E and the other end turn region E. The effective turn region A is formed of an unequal-pitch spring in which both ends are dense to have a small spring constant and the center is sparse to have a great spring constant. Accordingly, both ends of the coil spring 62 can easily absorb an impact and the center thereof can absorb a great impact, whereby the coil spring 62 can accumulate the same elastic energy as an equal-pitch spring as a whole. In the coil spring 62, an end, which has a small spring constant, which is close to the bottom dead center, and which includes one end turn region E, is defined as a first end 62A. An end, which has a small spring constant, which is close to the top dead center, and which includes the other end turn region E, is defined as a second end 62B. An approximately central portion, which includes the effective turn region A and which is a portion of the coil spring 62 having a great spring constant, is defined as a center portion 62C.

In a conventional nailer, an additional-end-turn coil spring having an unequal pitch in the first turn at the ends is generally used to enhance the close adhesion between the end of the coil spring driving the plunger and the plunger. However, since the second or later turn has an equal pitch, it is not greatly different in size and mass from a coil spring of which the entire turns have an equal pitch.

On the contrary, in the coil spring 62 according to this embodiment, the unequal-pitch region (effective turn region A) is disposed in about the second or later turn from the ends. A portion closer to the center has a greater pitch in the unequal-pitch region (effective turn region A). By employing this shape, it is possible to more markedly reduce the weight and size than the conventional coil spring.

As shown in FIG. 1, the plunger 63 includes the urging portion 63A and the blade 63B. The urging portion 63A is located at a lower end of the coil spring 62, is formed in a disk shape having substantially the same outer diameter as the outer diameter of the coil spring 62, and is connected to the other end of the wire 52 inserted into the coil spring 62 at the center thereof. Accordingly, the urging portion 63A is pulled by the wire 52 to move upward in the spring guide 61 against the urging force of the coil spring 62, thereby compressing the coil spring 62. A position where the urging portion 63A is urged and usually located by the coil spring 62 is defined as the bottom dead center. A position where the urging portion 63A is pulled up to the uppermost is defined as the top dead center.

The blade 63B is formed in a longitudinal plate shape and extends downward from the position which is the substantial center of the urging portion 63A and which is the rear surface of the connection position of the wire 52. A bumper 64 made of resin such as soft rubber and urethane is disposed below the urging portion 63A in the housing 2.

The nose portion 7 is disposed below the coil spring portion 6. A passage which is not shown but through which the blade 63B passes is formed in the nose portion 7.

The magazine 8 is attached to the nose portion 7 at a position below the motor 3 and has plural nails not shown therein. The nails not shown are supplied into the passage not shown and disposed in the nose portion 7 from the magazine 8.

At the time of driving a nail with the nailer 1 a worker grips the handle 21 to keep the nailer 1 substantially perpendicular to the top surface of the target member W and actuates the motor 3 by pulling the trigger 21A. The drum 51 rotates by the clutch mechanism 4 interlocking with the actuation of the motor 3 to wind the wire 52, the plunger 63 moves up to the top dead center, and the coil spring 62 is compressed to accumulate the elastic energy.

When the plunger 63 reaches the top dead center, the clutch mechanism 4 is intercepted and thus the drum 51 is rotatable. Accordingly, the urging force of the urging portion 63A to the coil spring 62 disappears and the elastic energy accumulated in the coil spring 62 is released, thereby rapidly pushing down the plunger 63 to the bottom dead center. Then, the nail supplied into the nose portion 7 from the magazine 8 is hit with the blade 63B, thereby driving the nail into the target member W.

Figure 3:
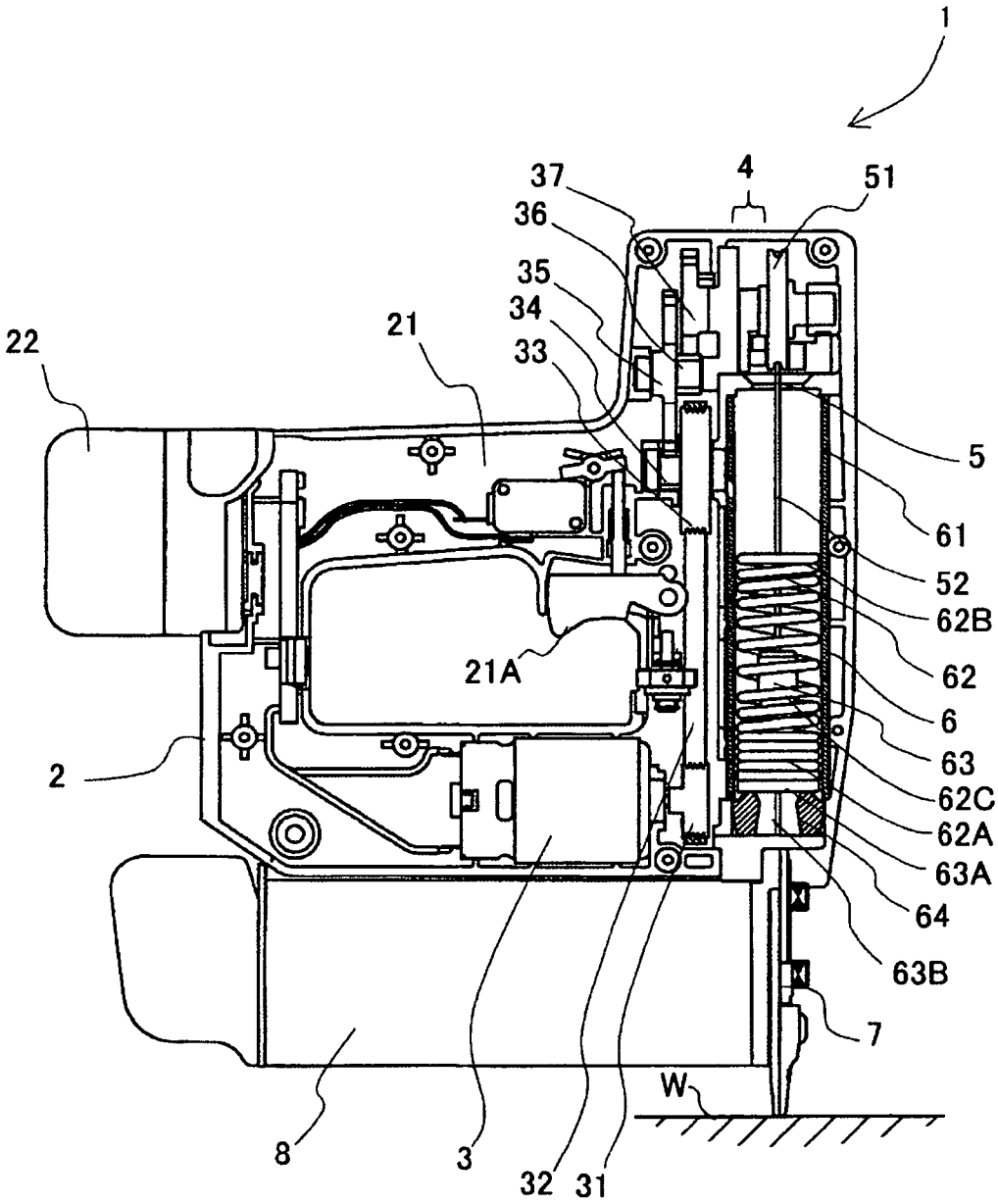
FIG. 3 is a cross-sectional view illustrating the nailer according to the embodiment where the coil spring moves to a bottom dead center.
Figure 4:
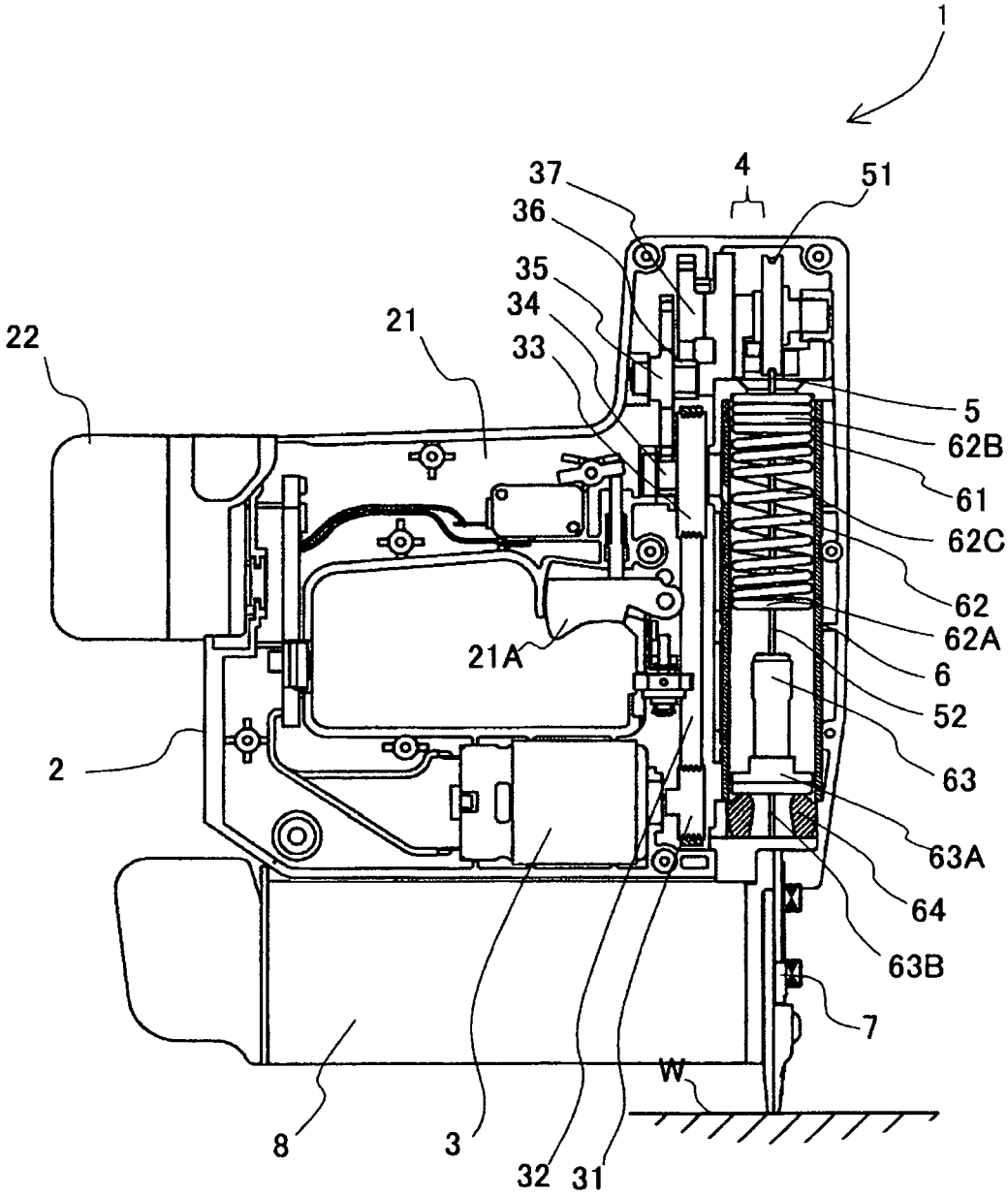
FIG. 4 is a cross-sectional view illustrating the nailer according to the embodiment where the coil spring moves to a top dead center.

The blade 63B goes down to the bottom dead center to hit the nail and stops its motion by colliding with the bumper 64. However, as shown in FIG. 3, the coil spring 62 moves to the bottom dead center at the time of hitting, the first end 62A reaches the position of the bottom dead center, the first end 62A starts being compressed, and then the second end 62B further goes to the bottom dead center, whereby the coil spring 62 is compressed as a whole and the elastic energy is accumulated at the position of the bottom dead center. After it is compressed to some extent, as shown in FIG. 4, the coil spring 62 goes up to the top dead center with the accumulated elastic energy and the second end 62B reaches the position of the top dead center, whereby the elastic energy is accumulated in the coil spring 62 again.

Since the coil spring 62 is oscillated and attenuated by repeating the above-mentioned action at the position of the top dead center and the position of the bottom dead center, the ends first reach the position of the top dead center and the position of the bottom dead center. Accordingly, both ends of the coil spring 62 are essentially expanded and compressed at the greatest speed. Therefore, the ends of the coil spring 62 suffer from an impact the most strongly. However, since both ends have a small spring constant, the ends easily absorbs the impact to suppress the deterioration of the coil spring 62. After one end of the coil spring 62 is compressed, the center portion 62C starts being compressed. However, since the center portion 62C has a great spring constant, it can sufficiently accumulate the elastic energy. Accordingly, since the coil spring 62 can accumulate the same elastic energy as the conventional spring not having an unequal-pitch as a whole, it is possible to prevent the deterioration of the coil spring 62 while maintaining the elastic force sufficient for nailing and to elongate the life time of the nailer 1.

The nailer according to the invention is not limited to the above-mentioned embodiment, but may be modified and improved in various forms without departing from the scope of the claims. Although the spring having different spring constants at both ends and at the center like the unequal-pitch spring has been suggested in the embodiment, for example, the spring constant may be made to vary by performing heat treatment on both ends and the center of an equal-pitch spring or varying a wire diameter thereof.

According to an aspect of the present invention, it is possible to reduce the size of the nailing machine and to elongate the lifetime thereof.

What is claimed is:

1. A nailing machine comprising:

a housing;

a motor disposed in the housing to rotate a drum;

a cylindrical guide disposed in the housing that defines an axial direction and a radial direction;

a wire member extending in the axial direction, one end being connected to the drum and the other end being connected to an urging member movable in the cylindrical guide in the axial direction;

a blade connected to the urging member for driving a nail into a target member; and a coil spring disposed in the cylindrical guide and including a first end potion positioned at an upper end of the cylindrical guide, a second end portion positioned at a lower end of the cylindrical guide and a central portion positioned between the first and second end portion, the coil spring is expanded or compressed by the motor to store an elastic energy therein and accelerates the urging member by releasing the elastic energy to drive the nail into the target member, wherein a coil pitch of the first end portion and the second end portion of the coil spring in the axial direction is smaller than that of the central portion of the coil spring.

2. The nailing machine according to claim 1, wherein a single coil spring is disposed in the cylindrical guide, extending from the upper end to the lower end of the cylindrical guide.

3. The nailing machine according to claim 1, further comprising a bumper disposed below the urging member in the housing.

4. The nailing machine according to claim 3, further comprising a clutch mechanism disposed between the motor and the drum, wherein the clutch mechanism is intercepted when the urging member reaches a top dead center so that the accumulated energy is released to push down the blade.

5. The nailing machine according to claim 1, wherein the coil spring is compressed to accumulate an energy when the drum is rotated to wind the wire member.

6. A nailing machine comprising:

a housing;

a motor disposed in the housing to rotate a drum;

a cylindrical guide disposed in the housing that defines an axial direction and a radial direction;

an urging member movable in the cylindrical guide in the axial direction;

a blade connected to the urging member for driving a nail into a target member; and a coil spring disposed in the cylindrical guide and including a first end portion positioned at an upper end of the cylindrical guide, a second end portion positioned at a lower end of the cylindrical guide and a central portion positioned between the first and second end portion, the coil spring is expanded or compressed by the motor to store an elastic energy therein and accelerates the urging member by releasing the elastic energy to drive the nail into the target member, wherein a spring constant of the first end portion positioned at the upper end of the cylindrical guide is set smaller than that of the central portion.

7. The nailing machine according to claim 6, further comprising a wire member extending in the axial direction, one end being connected to the drum and the other end being connected to the urging member.

8. The nailing machine according to claim 6, wherein a single coil spring is disposed in the cylindrical guide, extending from the upper end to the lower end of the cylindrical guide.

9. The nailing machine according to claim 7, wherein a spring constant of the second end portion positioned at the lower end of the cylindrical guide is set smaller than that of the central portion.

10. The nailing machine according to claim 9, wherein the ccil spring is compressed to accumulate an energy when the drum is rotated to wind the wire member.

11. The nailing machine according to claim 9, further comprising a clutch mechanism disposed between the motor and the drum, wherein the clutch mechanism is intercepted when the urging member reaches a top dead center so that the accumalated energy is released to push down the blade.

* * * * *